US006390606B1

(12) United States Patent
Terui et al.

(10) Patent No.: US 6,390,606 B1
(45) Date of Patent: May 21, 2002

(54) INK-JET HEAD, INK-JET HEAD SUBSTRATE, AND A METHOD FOR MAKING THE HEAD

(75) Inventors: Makoto Terui; Hirokazu Komuro, both of Yokohama; Norio Ohkuma, Machida, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/324,504

(22) Filed: Jun. 3, 1999

(30) Foreign Application Priority Data

Jun. 3, 1998 (JP) ..... 10-154389
Jun. 3, 1998 (JP) ..... 10-154390
Jun. 3, 1998 (JP) ..... 10-154391

(51) Int. Cl.[7] ..... B41J 2/05
(52) U.S. Cl. ..... 347/63; 347/44; 347/45
(58) Field of Search ..... 347/63, 44, 45, 347/47

(56) References Cited

U.S. PATENT DOCUMENTS 4,392,907 A * 7/1983 Shirato et al. ..... 347/63
4,567,493 A 1/1986 Ikeda et al. ..... 346/140 R
4,657,631 A 4/1987 Noguchi ..... 156/655
4,688,054 A 8/1987 Inamoto et al. ..... 356/140 R
4,720,716 A 1/1988 Ikeda et al. ..... 346/140 R
4,965,594 A 10/1990 Komuro ..... 346/140 R
5,096,968 A * 3/1992 Sasaki et al. ..... 525/142
5,140,345 A 8/1992 Komuro ..... 346/140 R
5,206,663 A * 4/1993 Yamamoto et al. ..... 347/209
5,211,754 A 5/1993 Komuro ..... 118/300
5,946,013 A 8/1999 Kurihara et al. ..... 347/64
6,135,589 A * 10/2000 Nakagomi et al. ..... 347/63

FOREIGN PATENT DOCUMENTS

| | | |
|---|---|---|
| EP | 0 521 517 | 1/1993 |
| EP | 0 885 723 | 12/1998 |
| JP | 54-51837 | 4/1979 |
| JP | 59-194866 | 11/1984 |
| JP | 61-154947 | 7/1986 |
| JP | 7-268095 | 10/1995 |
| JP | 8-267763 | 10/1996 |
| JP | 9-1806 | 1/1997 |

* cited by examiner

*Primary Examiner*—John E. Barlow, Jr.
*Assistant Examiner*—Manish S Shah
(74) *Attorney, Agent, or Firm*—Fitzpatrick, Cella, Harper & Scinto

(57) ABSTRACT

In an ink-jet head substrate including a thermal effect section for applying thermal energy to liquid to form a bubble in the liquid, the thermal effect section being connected with a nozzle for discharging the liquid, an electrothermal transducer for generating the thermal energy, and a pair of electrodes, a resin layer composed of a polyether amide is formed on the surface of the substrate.

19 Claims, 11 Drawing Sheets

INK-JET HEAD, INK-JET HEAD SUBSTRATE, AND A METHOD FOR MAKING THE HEAD

BACKGROUND OF THE INVENTION

1. Field of the Invention

The present invention relates to an ink-jet head for discharging liquid through an orifice and for forming droplets, an ink-jet head substrate, and a method for making the head.

2. Description of the Related Art

Japanese Patent Application Laid Open No. 54-51837 discloses an ink-jet recording process, which is different from other ink-jet recording processes. That is, thermal energy is applied to liquid. The heated liquid forms a bubble, and a force generated by the formation of the bubble discharges a droplet of the liquid through an orifice at the tip of an ink-jet head. The droplet adheres on a recording medium to record information.

The ink-jet head used in this recording process has a liquid-discharging section having an orifice for discharging droplets and a liquid channel provided with a heating section for imparting thermal energy to the liquid, an exothermic element as an electrothermal transducer which generates pressure capable of discharging ink, electrodes for applying electrical energy, and a substrate for holding these components. The head has a heat-accumulating layer provided between the exothermic element and the substrate, and an upper protective layer for protecting the exothermic element and the electrodes from ink.

Japanese Patent Application Laid-Open No. 59-194866 discloses an organic topmost layer formed on an upper protective layer, that is, a surface layer of the substrate. Tthe organic layer has small amounts of pinhole defects and has high coverage, although the layer does not have thermal resistance. Organic materials proposed as the surface layer of the substrate are silicone resins, fluorinated resins, polyamide resins, polyimide resins, epoxy resins, phenol resins, Zirox resins, triazine resins, and BT (bismaleimide-triazine) resins. Among these, polyimide resins are generally used since the resins can readily form films and have high ink resistance.

In recent ink-jet processes, use of various types of paper, for example, plain paper, is required. Thus, inks used in these processes have inherent properties which are different from that of conventional inks. Such inks readily spread on plain paper to decrease the print density compared with coated paper. The dye content in the ink must be increased to enhance the print density. The ink having a high dye content prompts precipitation or adhesion of the dye at a nozzle tip. Thus, urea as a humectant is added to the ink having a high dye content so that the dye does not adhere.

A head containing a urea-containing ink which is designed based on the above-described concept will break down after a long continuous operation. In the head, at failure, the polyimide resin layer on the substrate surface is lost. Thus, the polyimide resin is unsuitable for urea-containing inks. Accordingly, required organic resins must facilitate formation of films, and must have high resistance against urea-containing inks and thermal resistance.

In addition, inks capable of recording on various media, other than plain paper, are desirable. Furthermore, alkaline inks will be developed in future, instead of conventional neutral inks. Thus, ink-jet recording systems must allow use of a wide variety of inks.

Japanese Patent Application Laid-Open No. 61-154947 discloses a method for making an ink-jet head, in which a solid layer having a channel pattern is formed on a substrate, a material for forming a channel is provided thereon, and then the solid layer is removed. When a positive resist is used as the patterned solid layer and when an epoxy resin is used as the ink channel component, an aqueous inorganic or organic alkaline solution or a polar solvent is used to remove the positive resist. Use of a metallic material, such as aluminum, in the substrate and the top board has heat accumulation and material cost advantages compared to Si substrates. Such a metallic material may be dissolved in the aqueous inorganic or organic alkaline solution. Thus, use of a polar solvent such as ethyl cellosolve (ethylene glycol monoethyl ether) is preferable.

Since organic polar solvents dissolve polymeric compounds not soluble in nonpolar solvents, the use of organic polar solvents in production of ink-jet heads will form cracks and voids in the organic layer on the substrate surface or will completely dissolve the organic layer. Accordingly, the material used as the surface layer of the substrate must have resistance against a solution for removing the positive resist, in addition to resistance against the alkaline ink.

SUMMARY OF THE INVENTION

Accordingly, it is an object of the present invention to provide an ink-jet head substrate having a stable surface layer which is highly resistive against alkaline inks and polar solvents.

It is another object of the present invention to provide an ink-jet head.

It is still another object of the present invention to provide a method for making an ink-jet head.

An aspect of the present invention is an ink-jet head substrate including a thermal effect section for applying thermal energy to liquid to form a bubble in the liquid, the thermal effect section being connected with a nozzle for discharging the liquid, an electrothermal transducer for generating the thermal energy, and a pair of electrodes, wherein a resin layer composed of a polyether amide is formed on the surface of the substrate.

Another aspect of the present invention is an ink-jet head including a nozzle for discharging liquid, a liquid channel connected with the nozzle, a substrate having a pressure-generating element for discharging the liquid, the liquid channel including the pressure-generating element, and a liquid channel component bonded to the substrate to form the liquid channel, wherein the substrate has a resin layer comprising a polyether amide resin at the bonded section to the liquid channel component.

A third aspect of the present invention is a method for making an ink-jet head including a nozzle for discharging liquid, a liquid channel connected with the nozzle, a substrate having a pressure-generating element for discharging the liquid, the liquid channel including the pressure-generating element, and a liquid channel component bonded to the substrate to form the liquid channel, the method including the steps of forming a polyether amide layer on the pressure-generating element of the substrate, forming a liquid channel pattern on the polyether amide layer using a soluble resin, forming a covering resin layer for forming a liquid channel wall on the liquid channel pattern, forming the nozzle in the covering resin layer above the pressure-generating element, and dissolving the liquid channel pattern.

In the ink-jet head, the liquid channel component may be a top board having a groove for forming a part of the liquid channel.

The top board may be pressed and fixed to the substrate by an elastic member.

The ink-jet head in accordance with the present invention may be of an edge shooter type and of a side shooter type.

DESCRIPTION OF THE PREFERRED EMBODIMENTS

Figure 1:
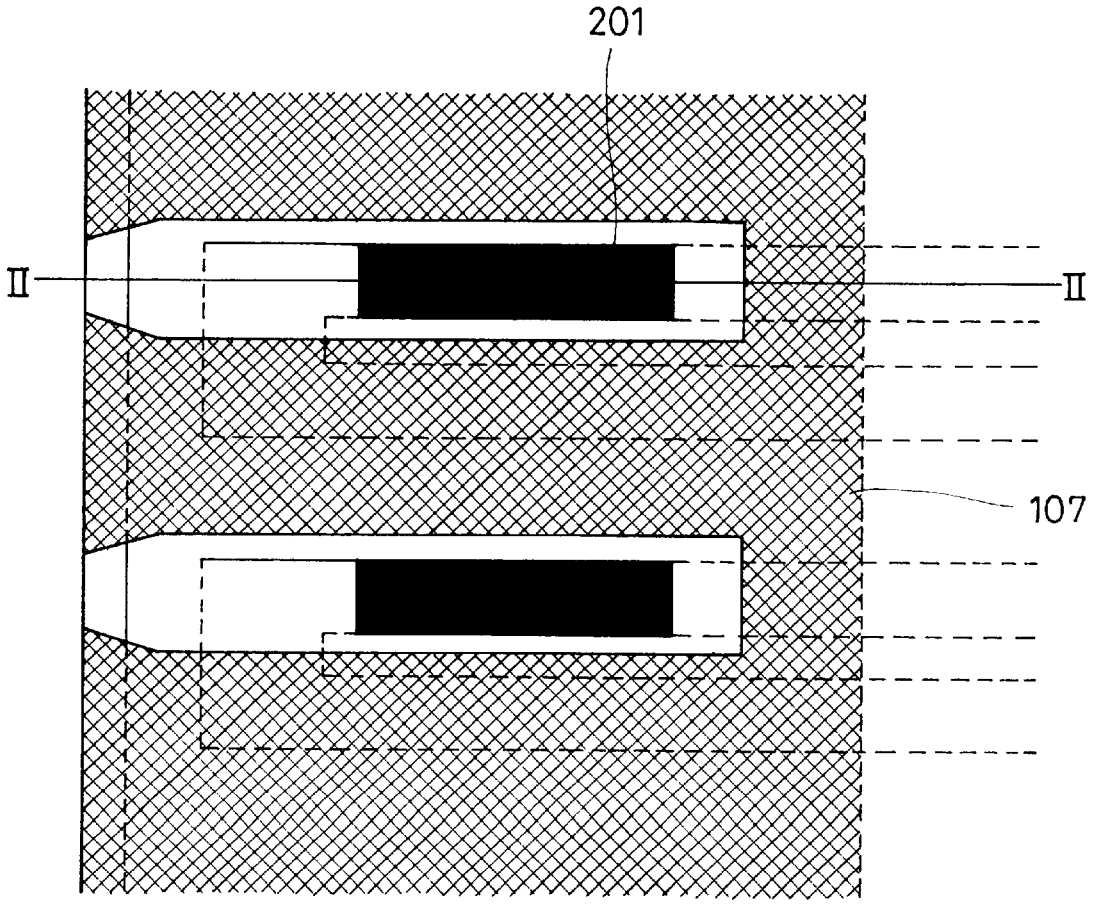
FIG. 1 is a plan view of an ink-jet head substrate in accordance with the present invention.
Figure 2:
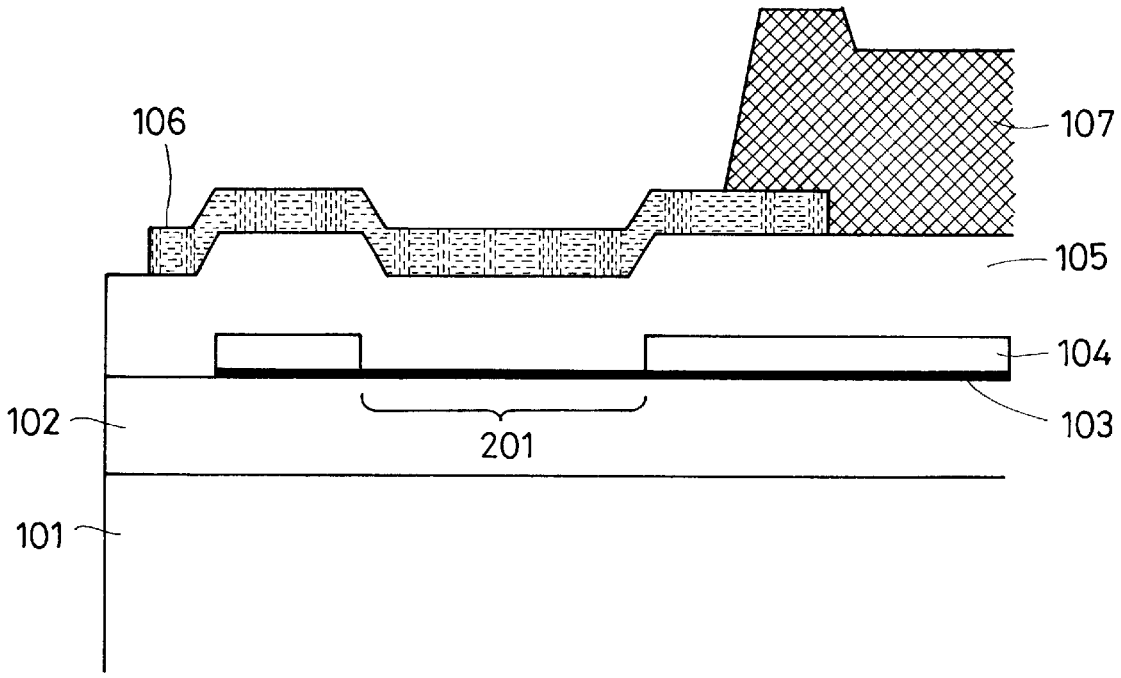
FIG. 2 is a cross-sectional view taken along line II—II in FIG. 1.
Figure 3:
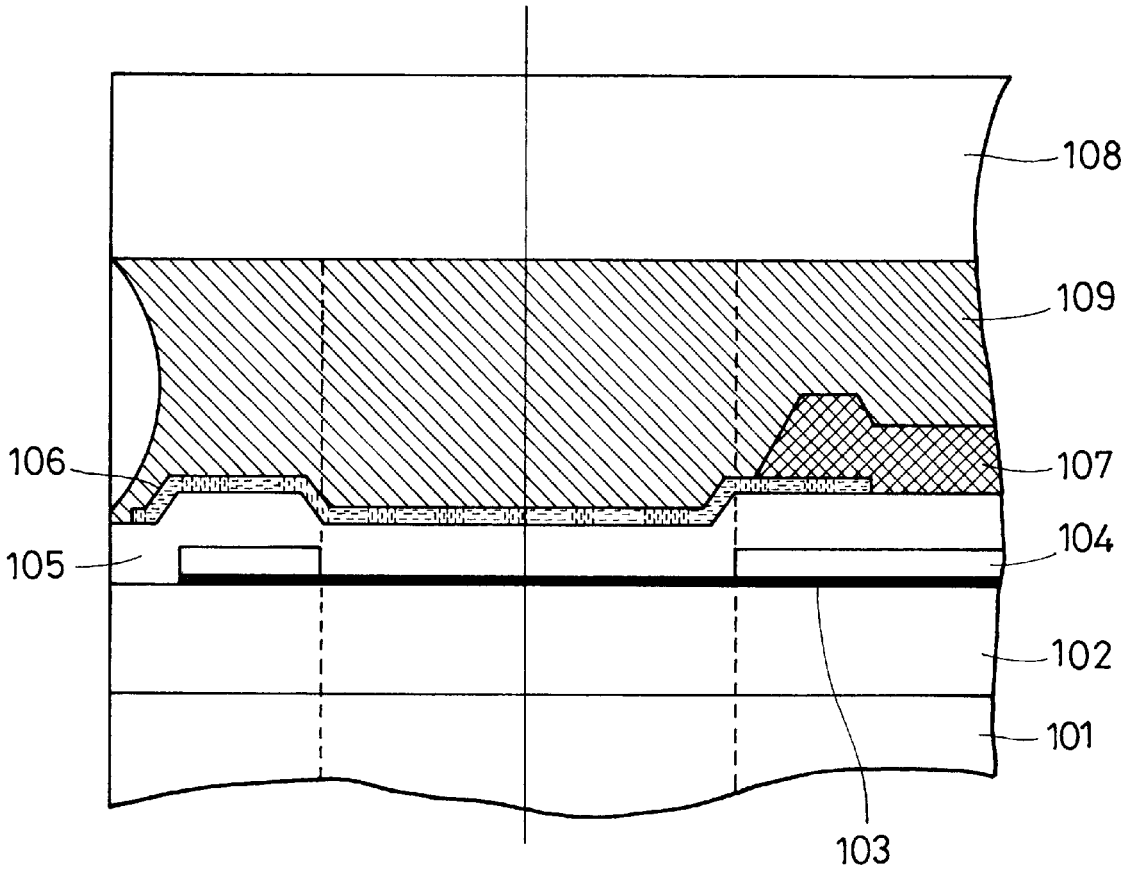
FIG. 3 is a cross-sectional view of an ink-jet head along the liquid channel.

FIG. 1 is a plan view of an ink-jet head substrate in accordance with the present invention, and FIG. 2 is a cross-sectional view taken along line II—II in FIG. 1. FIG. 3 is a cross-sectional view of an ink-jet head using the substrate shown in FIG. 1.

With reference to FIGS. 2 and 3, a substrate 101 is generally composed of silicon, ceramic or metal. An electrothermal transducer consisting of an exothermic layer 103 and electrode layers 104 is provided above the substrate 101. The exothermic layer 103 is composed of, for example, TaN or $HfB_2$, and the electrode layers 104 are composed of, for example, aluminum. When a voltage is applied to the electrothermal transducer based on driving information, the portion of the exothermic element 201 not covered with the electrode layers 104 is heated. A heat-accumulating layer 102 composed of $SiO_2$ or the like is provided on the substrate 101 so as to effectively conduct the heat generated in the exothermic element 201 to ink. Thus, the exothermic element 201 is formed on the heat-accumulating layer 102. In this embodiment, three protective layers 105, 106 and 107 are formed on the electrothermal transducer to protect the exothermic element 201 from electrolytic corrosion, although the number of the protective layers is not limited. The first protective layers 105 is composed of inorganic insulator such as $SiO_2$ and the second protective layer 106 is composed of Ta or the like and functions as a cavitation resistant layer. Furthermore, the third protective layer 107 composed of a polyether amide is provided in order to improve ink resistance of the first protective layer 105. It is preferable that the polyether amide protective layer 107 be not provided right above the exothermic element 201 in view of thermal resistance, Thus, the polyether amide film is patterned as shown in FIG. 1. The patterning is preferably performed by any dry etching process. In particular, an oxygen plasma ashing process is suitable for highly precise patterning. The polyether amide protective layer 107 is generally formed by coating of a polyether amide solution, and the residual solvent content affects the ink resistance of the protective layer 107. According to results by the present inventors' research, a residual solvent content of 4% or less causes high resistance against the above-mentioned alkaline inks. In addition, a residual solvent content of 0.5% or less causes high resistance against the above-mentioned polar solvents. Such preferable residual solvent contents can be achieved by baking of the polyether amide film at a high temperature. When the polyether amide film is baked at a temperature which is higher than the glass transition temperature (230° C.) or more of the polyether amide, the layer has high resistance against both the alkaline inks and the polar solvents.

With reference to FIG. 3, a top board 108 having grooves is assembled on the protective layers so as to form ink channels 109 of the ink-jet substrate. The grooved top board 108 is formed by etching of glass or molding of a resin, such as polysulfone or polyether sulfone. When the grooved top board 108 is formed by resin molding, the grooved top board 108 may be pressed onto the substrate using an elastic member not shown in the drawing, such as a presser bar spring to correct a warp formed during the molding. Since the polyether amide protective film 107 extends to the bonding sections to the grooved top board 108, the grooved top board 108 can be more firmly bonded to the substrate. In a conventional configuration, a second protective layer composed of thallium is provided at bonding sections of a grooved top board, and the thallium has a Young's modulus of $1.90\times10^4$ kgf/cm$^2$. In contrast, the polyether amide used in the present invention has a Young's modulus of 260 kgf/cm$^2$ and is substantially the same as that of polysulfone which is generally used in the grooved top board 108. The polyether amide protective layer 107 is also deformed together with the grooved top board 108 by the pressing force to improve the bonding state. Since this Young's modulus is lower than that (300 kgf/cm$^2$) of a polyimide used in a conventional third protective layer, the bonding state in the present invention is improved compared to a configuration using a polyimide as the third protective layer.

A single protective layer configuration may also be employed in the present invention. This embodiment shows an edge shooter-type configuration in which discharge nozzles (not shown in the drawing) are formed at the ends of the ink channels 109. The present invention is also applicable to a side-shooter type head having discharge nozzles provided above an exothermic element.

Experiments for investigating the ink resistance of the polyether amide film will now be described.

Experiment 1

A $SiO_2$ film having a thickness of 2.5 $\mu$m was formed on a Si wafer substrate by thermal oxidation. A 2.5-$\mu$m thick polyether amide film of HIMAL HL-1200 (Trade Name by Hitachi Chemical Co., Ltd.) was formed at the shaded section in FIG. 3 by the following steps. The substrate was cleaned and dried, and then a polyether amide solution (solvent: n-methyl-2-pyrrolidone) having a viscosity of 500 cP was coated onto the thermally oxidized $SiO_2$ film using a spinner. The solvent was preliminarily removed at 70° C. for 30 minutes. The preliminarily dried substrate was baked under the conditions shown in Table 1 to prepare a plurality of samples. The residual solvent content in these films was determined by gas chromatography. Using a testing ink, which was composed of 5 percent by weight of ethylene glycol, 5 percent by weight of urea, and the balance being water, a preservation test at 60° C. and a pressure cooker test (PCT) were performed to observe the state of each film and a change in thickness of the film. The results are shown in Table 1.

As shown in Table 1, all the polyether films did not disappear after the preservation at 60° C. for three months and after the PCT. For comparison, a 2.5-μm thick polyimide film of Photoneece (trade name, by Toray Industries, Inc.) was baked at 400° C. and subjected to the preservation test at 60° C. for three months and the TCT test. The Photoneece film disappeared after the preservation test. When the residual solvent content in the polyether amide film was 4.0% or less, no disappearance of the film was observed although the film was swelled by water in the tested ink.

These results show the polyether amide film in accordance with the present invention has high alkaline resistance, and particularly high resistance when the residual solvent content in the polyether amide film is 4.0% or less.

TABLE 1

| Baking Conditions | Residual Solvent Content in Film (%) | Change (μm) in Thickness from Initial Thickness (2.5 μm): After Preservation at 69° C. for three months | Change (μm) in Thickness from Initial Thickness (2.5 μm): After PCT (120° C., 2 atms, 10 hours) |
|---|---|---|---|
| 80° C., 30 minutes | 5.90 | −0.80 | −1.00 |
| 120° C., 30 minutes | 4.10 | −0.50 | −0.80 |
| 120° C., 45 minutes | 4.00 | 0.02 | 0.08 |
| 120° C., 60 minutes | 3.20 | 0.03 | 0.11 |
| 120° C., 180 minutes | 1.40 | 0.08 | 0.16 |
| 150° C., 180 minutes | 0.80 | 0.08 | 0.16 |
| 180° C., 180 minutes | 0.60 | 0.08 | 0.16 |

Experiment 2

A $SiO_2$ film having a thickness of 5 μm was formed on a 5-inch Si wafer substrate by thermal oxidation. A 2.5-μm thick polyether amide film of HIMAL HL-1200 (Trade Name by Hitachi Chemical Co.) was formed as in Experiment 1. The solvent was preliminarily removed at 70° C. for 30 minutes. The preliminarily dried substrate was baked under the conditions shown in Table 2 to prepare Samples 1 to 5. The residual solvent content in these films was determined by gas chromatography. These films were immersed in ethyl cellosolve for 4 hours to observe the state of the film and to measure the change in the film thickness.

Table 4 shows that the polyether amide films (Samples 4 and 5), which were baked at a temperature higher than the glass transition temperature (230° C.) so as to control the residual solvent content to 0.5% or less, have high resistance against crack formation and dissolution in the polar ethyl cellosolve solvent. Samples 4 and 5 were subjected to the preservation test at 60° C. and the PCT (120° C., 2 atm, 10 hr) using the testing ink as in Example 1. The film thickness was not decreased in the testing ink.

TABLE 2

| Sample | Baking Conditions | Residual Solvent Content (% by weight) | Change after immersing in in Ethyl Cellosolve for 4 hours | Change in Film Thickness from Initial Thickness (μm) |
|---|---|---|---|---|
| 1 | 120° C., 30 min | 4.1 | Many cracks and voids formed | −0.3 |
| 2 | 120° C., 45 min | 4.0 | Many cracks and voids formed | −0.3 |
| 3 | 180° C., 180 min | 0.6 | Many cracks and voids formed | −0.1 |
| 4 | 240° C., 180 min | 0.5 | No change | +0.2 |
| 5 | 300° C., 180 min | 0.2 | No change | +0.2 |

EXAMPLE 1

An ink-jet head was prepared according to the following process and subjected to discharging tests.

As shown FIGS. 1 and 2, a 5-inch silicon wafer as a substrate 101 was thermally oxidized to form a 2.5-μm thick $SiO_2$ film as a heat-accumulating layer 102. A 0.15-μm thick exothermic element 103 composed of $HfB_2$ was formed on the heat-accumulating layer 102 by a sputtering process. Then, a titanium (Ti) layer with a thickness of 0.005 μm and an aluminum (Al) layer with a thickness of 0.5 μm were continuously deposited thereon to form an electrode layer 104 by an electron beam deposition process. The electrode layer 104 was patterned by a photolithographic process, as shown in FIGS. 1 and 2. The resulting heating zone 201 of the exothermic element 103 had a width of 30 μm, a length of 150 μm, and a resistance, including that of the aluminum electrode, of 150 Ω.

Silicon oxide ($SiO_2$) was deposited on the entire substrate 101 to form a first protective layer 105 with a thickness of 2.2 μm. Thallium was deposited on the entire surface of the first protective layer 105 by a sputtering process and then patterned to form a second protective layer 106 with a thickness of 0.5 μm.

As as shown by the hatching pattern in FIGS. 1 and 2, a polyether amide layer 107 with a thickness of 2.5 μm was formed on the Ta second protective layer 106 by the following process.

The substrate 101 having the second protective layer 106 was cleaned and dried. A polyether amide solution having a viscosity of 500 cP was coated onto the second protective layer 106 using a spinner. After drying it at 70° C. for 30 minutes, the polyether amide layer was baked under the conditions shown in Table 3 to prepare Samples A, B and C.

After the baking, a novolak positive photoresist OFPR800 (Trade name by Tokyo Ohka Kogyo Co., Ltd.) with a thickness of 12 μm was coated on the polyether amide film using a spinner, and prebaked. The photoresist layer was exposed using a mask aligner, and developed to form a predetermined pattern. The substrate was placed into an oxygen plasma ashing system to ash the polyether amide. The ashing rate of the polyether amide was 0.2 μm/min without being affected by the baking conditions. The polyether amide with a thickness of 2.5 μm was ashed for 15 minutes in the oxygen plasma atmosphere. Next, the substrate was immersed into a remover (Sipray 1112A), and the residual photoresist layer was removed by ultrasonic energy.

The polyether amide film had a thickness of 2.5 μm after removal of the photoresist layer. The ashed section of the polyether amide film, near the thermal effect section, had a shape shown in FIG. 2 and a size of 50 μm×250 μm.

The wafer was cut into individual head substrates, and a glass top board 108 having grooves with a width of 50 μm, a depth of 50 μm and a length of 2 mm was bonded onto each of the cut substrates to form ink channels 109, as shown in FIG. 3.

Pulses of 30-volts, 10-μsec, and 3-kHz were applied to the electrothermal transducers of the resulting ink-jet head. Droplets of the ink stored in the orifices were stably discharged in response to the applied signals. This operation was continued until the head did not discharge the ink droplets due to disconnection caused by electrolytic corrosion of the aluminum electrode and broken insulation between the protective layer and the aluminum electrode. The number of the repeated cycles was used as a measurement of durability.

Durability was compared using three polyether amide samples (Samples A, B and C) baked under different conditions and a Photoneece (polyimide) sample. The results are shown in Table 3.

TABLE 3

| Sample | Baking Conditions | Residual Solvent Content (% by weight) | Print quality After less than $10^7$ cycles | After $10^7$ to $10^9$ cycles | After more than $10^9$ cycles |
|---|---|---|---|---|---|
| A | 120° C., 30 min | 4.1 | Good | Not good | Not good |
| B | 120° C., 45 min | 4.0 | Good | Good | Good |
| C | 180° C., 180 min | 0.6 | Good | Good | Good |
| Photoneece (PI) | 400° C. | — | Not good | Not good | Not good |

Table 3 shows that the heads in accordance with the present invention, that is, Samples B and C, in which the residual solvent content in the polyether amide film is 4.0 percent by weight or less, have high durability, that is, good printing quality after more than $10^9$ repeated cycles. In contrast, in Sample A and the Photoneece sample, electrolytic corrosion of the aluminum electrode due to immersion of the ink through pinholes in the $SiO_2$ or thallium sputtered layer is noticeable. Electrolytic corrosion of the Photoneece sample is particularly noticeable and thus deterioration of the quality of the print is significant.

EXAMPLE 2

Using a polyether amide film formed under the baking conditions for Samples 3 to 5 in Experiment 2, ink-jet heads for discharging tests were produced under a process disclosed in Japanese Patent Application Laid-Open No. 61-154947 in which a solid layer was provided on an ink channel pattern of a substrate, at least a part of a channel-forming member was provided thereon, and the solid layer was removed from the substrate. A polyether amide protective layer was formed on the substrate as in Experiment 2, a photoresist PMER P-AR900 (trade name by Tokyo Ohka Kogyo Co., Ltd.) with a thickness of 30 μm was applied onto the substrate, and patterned to form ink channels. The pattern was covered with an epoxy photo-curable resin. The epoxy resin was exposed at a dose of 8.5 J/cm$^2$ to be cured, and the substrate was cut using a dicing machine to form discharge nozzles. The PMER P-AR900 photoresist was removed in ethyl cellosolve as a polar solvent.

The resulting ink-jet heads were subjected to the continuous discharging tests as in Example 1. The results are shown in Table 4, wherein Samples 3 to 5 in Table 4 correspond to Samples 3 to 5 in Table 2, respectively.

Table 4 demonstrates that Samples 4 and 5 having a residual solvent content in the polyether amide film of 0.5 percent by weight or less shows high print quality after more than $10^9$ operation cycles. Thus, these ink-jet heads are suitable for a multiple head. The print quality of Sample 3 is significantly inferior to that of Samples 4 and 5 after $10^7$ to $10^9$ printing cycles, although no problem in durability occurs. After $10^9$ printing cycles, electrolytic corrosion of the aluminum electrode due to immersion of the ink through pinholes in the $SiO_2$ or thallium sputtered layer is noticeable.

TABLE 4

| Sample | Baking Conditions | Residual Solvent Content (% by weight) | Print quality After less than $10^7$ cycles | After $10^7$ to $10^9$ cycles | After more than $10^9$ cycles |
|---|---|---|---|---|---|
| 3 | 180° C., 180 min | 0.6 | Good | Not good | Not good |
| 4 | 240° C., 180 min | 0.5 | Good | Good | Good |
| 5 | 300° C., 180 min | 0.2 | Good | Good | Good |

Accordingly, a highly reliable multiple head can be produced by the process disclosed in Japanese Patent Application Laid-Open No. 61-154947, by baking the polyether amide at a temperature higher than the glass transition temperature thereof and by controlling the residual solvent content to 0.5% or less.

EXAMPLE 3

Two ink-jet heads were produced using ink-jet head substrates having polyether amide films formed under the baking conditions for Samples 4 and 5 in Experiment 2 by the following process, and subjected to discharging tests.

Figure 4:
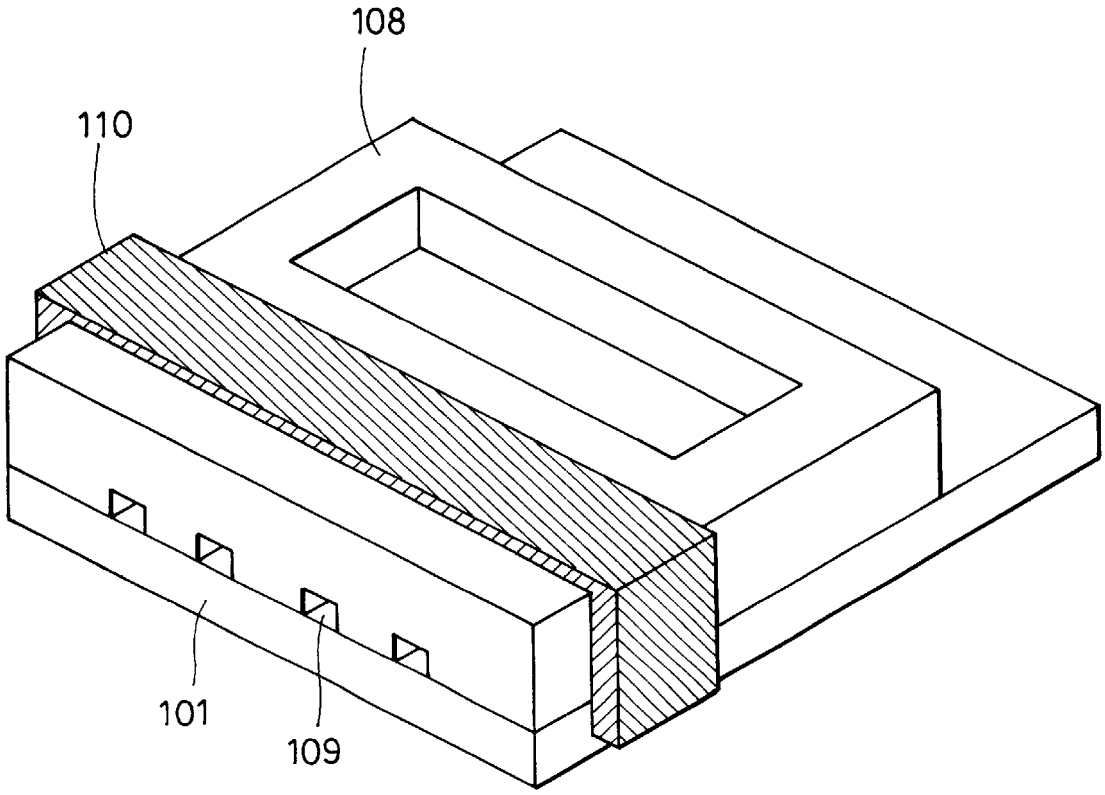
FIG. 4 is a schematic view of an ink-jet head of Example 3.

With reference to FIG. 4, a polyether amide protective layer was formed on each substrate 101 as in Experiment 2, and a polysulfone grooved top board 108 was precisely placed on the substrate 101 so that each exothermic element corresponds to an ink channel. The grooved top board 108 and the substrate 101 were fixed using a phosphor bronze presser bar spring 110. The polyamide film was patterned so as to extend to the section in contact with the top board. The print quality of these heads was high after discharge durability tests.

In the above-mentioned examples, each head has an edge shooter configuration in which ink is discharged substantially parallel to the exothermic element. The present invention is also applicable to a side shooter-type head.

EXAMPLE 4

In a bubble-jet head for generating an ink discharging force using an exothermic element, forming a bubble by membrane boiling of ink to discharge the ink, an inorganic insulating layer composed of SiN or $SiO_2$ and a thallium anti-cavitation layer are generally provided on the exothermic element to reduce damage due to cavitation caused by electrolytic corrosion of the ink and defoaming of the bubble. Since the thallium film has low bonding force to a resin as an ink channel component, detachment of the ink channel component from the thallium film will occur.

A possible method for improving the bonding force is removal of the thallium film at the portion for providing the ink channel component. In such a case, a resin is formed on the electrothermal transducer with only the inorganic insulating layer provided therebetween. Since the inorganic insulating layer is generally porous and permeates ions contained in the resin, these ions will cause electrolytic corrosion of the electrothermal transducer.

The substrate may be subjected to treatment using a silane coupling agent or may be provided with an overlying resin layer composed of a polyimide (for example, Photoneece made by Toray Industries, Inc.) to improve the bonding force between the substrate having an ink-discharging force generating element and the ink channel component.

Separation between the substrate and the ink channel component caused by ink must be avoided during operation under ordinary conditions. Weakly alkaline inks, which have been recently used due to the required use of a variety of recording sheets and water resistance of inks, will decrease the bonding force between the substrate and the ink channel component during long-term use.

A polyether amide resin layer as the bottom layer of the substrate can maintain high bonding force for long periods even when an alkaline ink is used and even when the metal such as thallium is exposed on the bonding face, as described below.

Experiment 3

A polyether amide resin layer was provided between a substrate and a nozzle material and the bonding force was evaluated using a weakly alkaline ink by an accelerated test. Hereinafter, the polyether amide resin layer is referred to as a bonding layer.

A 5-inch silicon wafer was thermally oxidized to form a 1.0-$\mu$m $SiO_2$ layer. A N-methylpyrrolidone/butyl cellosolve acetate solution of a polyether amide resin HIMAL1200 made by Hitachi Chemical Co., Ltd. was coated thereon by a spin coating process, and heated at 100° C. for 30 minutes and then at 250° C. for one hour to form a bonding layer with a thickness of 1.5 $\mu$m. The heating of the thermoplastic polyether amide was performed to evaporate the solvents and to reduce internal stress at a temperature higher than the glass transition temperature (230° C.).

A dry film resist RISTON (trade name by DuPont) with a thickness of 20 $\mu$m was laminated on the substrate and patterned using a mask aligner PLA600 to form a line-and-space pattern with an interval of 30 $\mu$m. The substrate was heated at 150° C. for one hour to completely cure the pattern.

A sample not having a bonding layer and a sample having a 1.5-$\mu$m thick bonding layer composed of a polyimide Photoneece UR3100 made by Toray Industries, Inc. and baked at 400° C. were also prepared for comparison.

These samples were immersed into an ink composed of ethylene glycol/urea/isopropyl alcohol/black pigment/water=5/3/2/3/87 parts by weight and then were subjected to PCT at 120° C. in 2 atm for 50 hours to observe a change in the line-and space pattern. The ink contained urea as a humectant for suppressing evaporation of the ink and preventing clogging in the nozzle, and was weakly alkaline due to hydrolysis of the urea.

In the sample having the polyether amide bonding layer in accordance with the present invention, the pattern shape did not change after the PCT test. In contrast, in the sample not having the bonding layer, an interference fringe or separation were observed in a part of the pattern, probably due to insufficient bonding between the $SiO_2$ layer and the nozzle material. In the sample having the polyimide bonding layer, the polyimide layer disappeared by dissolution.

Accordingly, the polyether amide bonding layer in accordance with the present invention has high bonding force and high ink resistance.

Experiment 4

The following is an example using a substrate having a SiN layer and a Ta layer and an epoxy resin nozzle material (ink channel component). A 1.0-$\mu$m thick SiN film and a 0.25-$\mu$m thick thallium film were formed on a 5-inch wafer as a substrate by a plasma enhanced CVD process. A polyether amide film was formed as in Experiment 3, and a solution of the following epoxy resin composition was applied on the polyether amide film and then patterned.

| | |
|---|---|
| Epoxy resin EHPE (trade name by Diacel Chemical Industries, Ltd.) | 100 parts by weight |
| Resin 1.4-HFAB (trade name by Central Glass Co., Ltd.) | 20 parts by weight |
| Silane coupling agent A-187 (trade name by Union Carbide Japan KK) | 5 parts by weight |
| Optical cationic polymerization catalyst SP170 (trade name by Asahi Denka Kogyo K.K.) | 2 parts by weight |

This composition was patterned by cationic polymerization of the epoxy resin by light irradiation of a dose of 3.0 J/cm$^2$ using a mask aligner MPA600 made by Canon Kabusiki Kaisha, heated at 90° C. for 30 minutes on a hot plate, developed in a methyl isobutyl ketone/xylene mixed solvent, and heated at 180° C. for one hour to completely cure the resin. A line-and-space pattern with a thickness of 20 μm and an interval of 30 μm was thereby formed, as in Experiment 3. The sample was subjected to a PCT to observe a change in the line-and space pattern. No change in the pattern was observed in this sample having the polyether amide bonding layer in accordance with the present invention. In contrast, in a sample not having a bonding layer, an interference fringe and separation, probably caused by insufficient bonding force between the Thallium layer and the nozzle material, were observed in a part of the pattern.

An ink-jet head was prepared by the following procedure.

Figure 5:
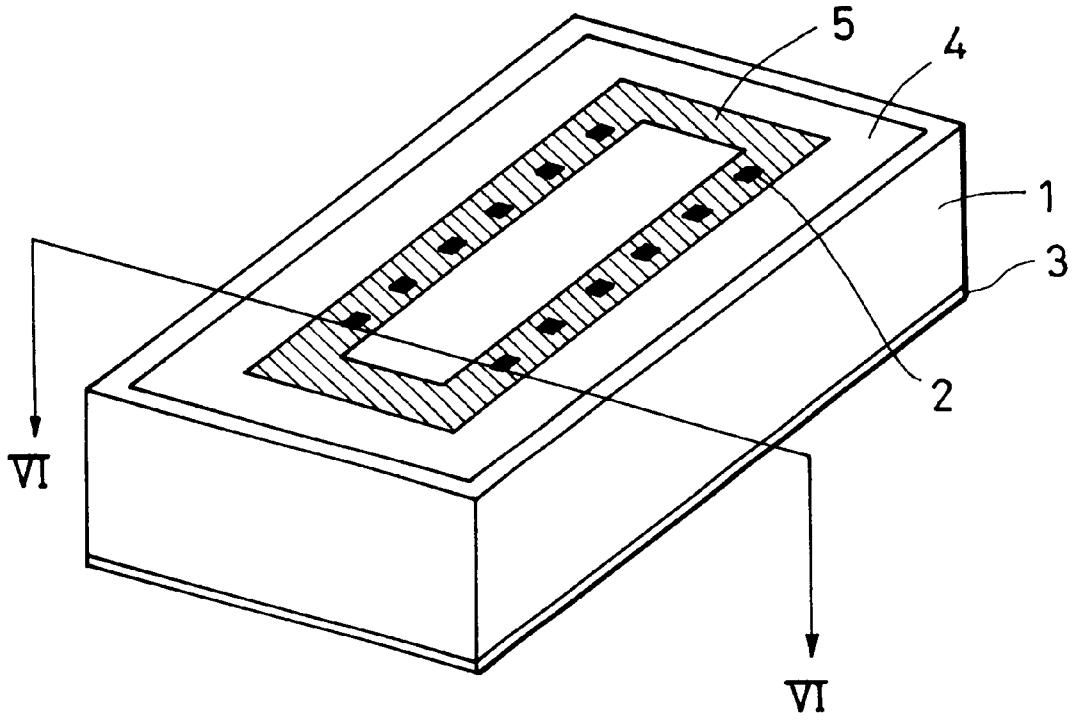
FIG. 5 is an isometric view of an ink-jet head substrate of Example 4.
Figure 6:
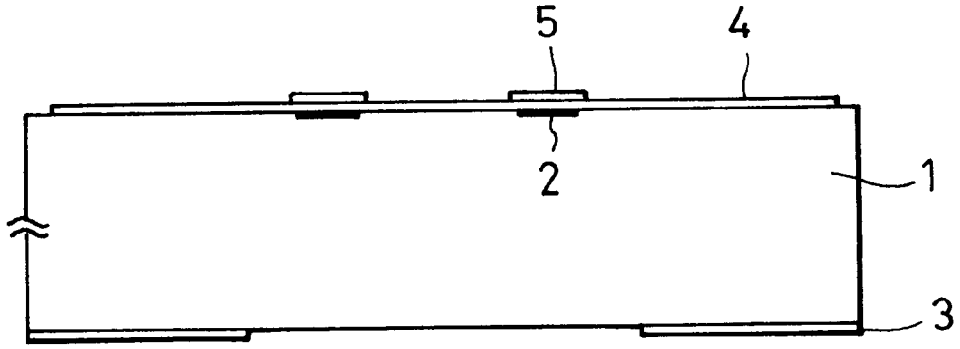
FIGS. 6 to 11 are cross-sectional views for illustrating a method for making an ink-jet head of Example 4.

With reference to FIG. 5, a TaN electrothermal transducer 2 for generating pressure was formed on a silicon wafer substrate of a <100> crystal axis having an ink nozzle mask 3. Also, a SiN layer 4 and a thallium layer 5 were formed as protective layers. The electrothermal transducer 2 was connected to electrodes for inputting control signals (not shown in the drawing). FIG. 6 is a cross-sectional view taken along line VI—VI in FIG. 5.

Figure 7:
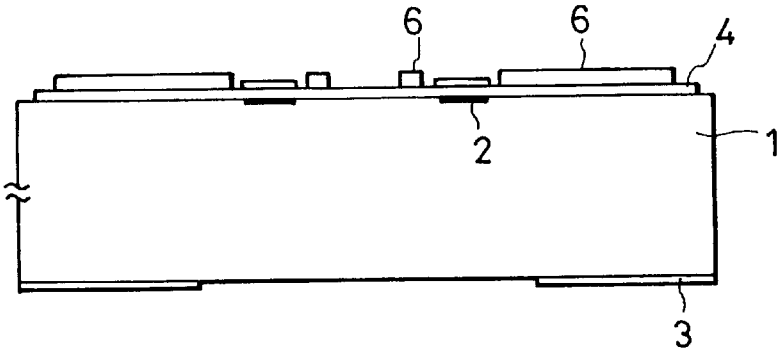

With reference to FIG. 7, a polyether amide bonding layer 6 with a thickness of 2.0 μm was formed on the substrate 1 as follows. The polyether amide used was HIMAL1200 made by Hitachi Chemical Co., Ltd. The polyether amide was coated on the substrate 1 using a spinner and baked at 100° C. for 30 minutes and then at 250° C. for one hour.

A positive resist OFPR800 made by Tokyo Ohka Kogyo Co., Ltd. was patterned on the polyether amide, and then the polyether amide layer was patterned by oxygen plasma ashing through the resist mask. The resist mask was removed to form a bonding layer 6.

Figure 8:
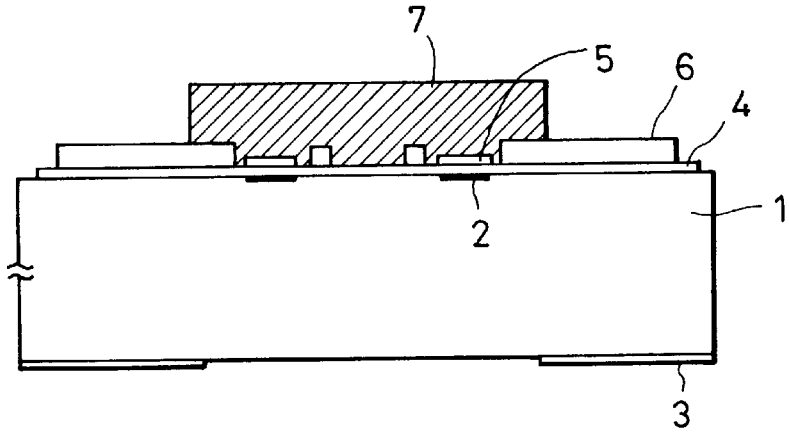

With reference to FIG. 8, an ink channel pattern 7 with a thickness of 12 μm composed of a positive resist ODUR made by Tokyo Ohka Kogyo Co., Ltd. was formed on the substrate 1.

Figure 9:
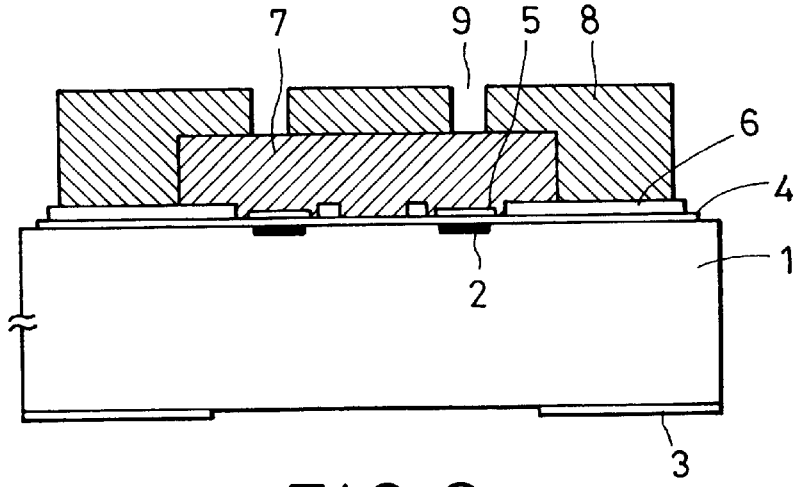

With reference to FIG. 9, an epoxy resin layer 8 was formed on the substrate 1, as in Experiment 4, and patterned to form discharge nozzles 9.

Figure 10:
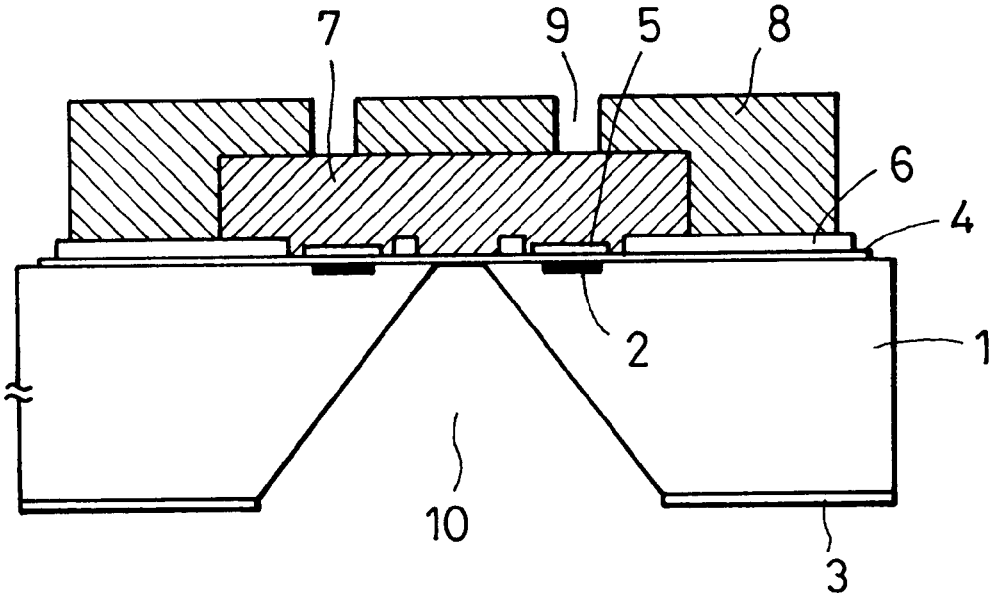

With reference to FIG. 10, the silicon substrate 1 was subjected to anisotropic etching to form an ink supply port 10.

Figure 11:
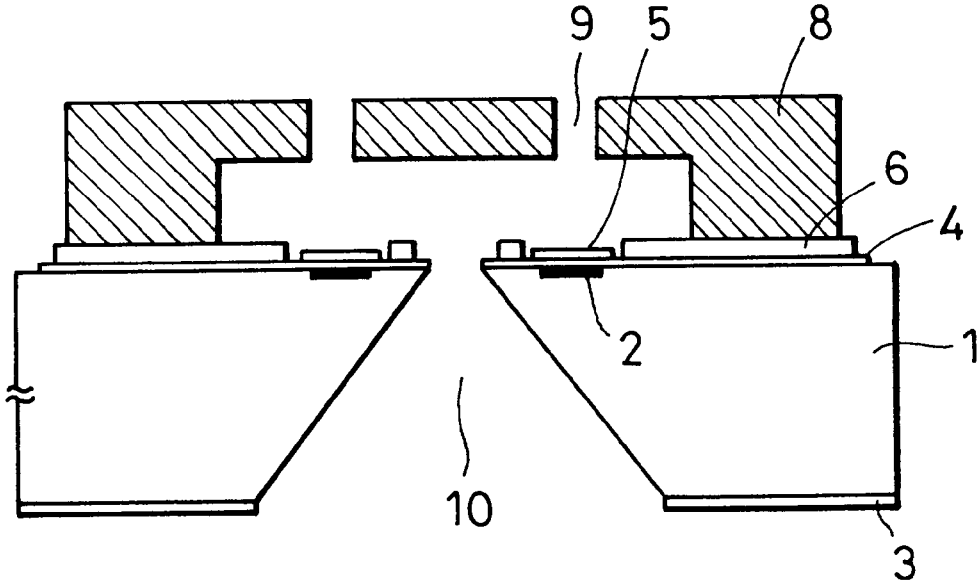

With reference to FIG. 11, the SiN layer 4 above the ink supply port 10 and the ink channel pattern 7 were removed, and then the substrate was heated at 180° C. for one hour to complete curing of the epoxy resin 8. The epoxy resin 8 as a nozzle component was bonded to the surface (thallium+SiN) of the substrate 1 with the bonding layer 6 provided therebetween.

An ink-jet head without a bonding layer 6 was also prepared for comparison. Thus, the nozzle component 8 of the comparative ink-jet head was directly bonded to the surface (thallium+SiN) of the substrate 1.

These ink-jet heads filled with the ink described in Experiment 3 were subjected to preservation tests at 60° C. for three months. The ink-jet head of this example having the bonding layer did not show an interference fringe and separation at the bonded interface of the nozzle component. In contrast, the comparative ink-jet head without a bonding layer formed a partial interference fringe between the thallium layer and the nozzle component. Accordingly, the polyether amide bonding layer in accordance with the present invention has high bonding strength in an ink-jet head which can be used in practice.

EXAMPLE 5

When a polyether amide film is used as the surface layer of a substrate, the substrate can be bonded to an ink channel component by the polyether amide film provided therebetween, as described in detail below.

A 2.5-μm thick $SiO_2$ film as a heat-accumulating layer was formed on a 5-inch silicon wafer substrate by thermal oxidation. A 0.15-μm $HfB_2$ layer was formed on the silicon wafer substrate by a sputtering process to form an exothermic element. A 0.005-μm thick thallium layer and then a 0.5-μm thick aluminum layer were deposited thereon by an electron beam deposition process to form electrode layers. The electrode layers were patterned by a photolithographic process, as shown in FIG. 1. The heater 201 in FIG. 1 had a width of 30 μm, and a length of 150 μm. The resistance of the heater including the aluminum electrode was 150 Ω.

$SiO_2$ with a thickness of 2.2 μm was deposited on the entire surface of the substrate by a sputtering process to form a first protective film. Next, thallium with a thickness of 0.5 μm was deposited on the entire surface thereof by a sputtering process to form a second protective layer, and then patterned.

Next, a 3-μm thick polyether amide layer as a protective layer 107 was formed on the hatched portion in FIG. 1, as follows. The substrate 101 having the second protective layer 106 was cleaned and dried. A polyether amide (HIMAL) solution having a viscosity of 500 cP was coated onto the second protective layer 106 using a spinner. After drying it at 70° C. for 30 minutes, the polyether amide layer was baked at 70° C. for 3 hours.

After the baking, a novolak positive photoresist OFPR800 (Trade name by Tokyo Ohka Kogyo Co., Ltd.) with a thickness of 12 μm was coated on the polyether amide film using a spinner, and prebaked. The photoresist layer was exposed using a mask aligner, and developed to form a predetermined pattern. The substrate was placed into an oxygen plasma ashing system to ash the polyether amide. The ashing rate of the polyether amide was 0.2 μm/min without being affected by the baking conditions. The polyether amide with a thickness of 2.5 μm above the heater 201 was removed by ashing for 15 minutes in the oxygen plasma atmosphere. Next, the substrate was immersed into a remover (Sipray 1112A), and the residual photoresist layer was removed by ultrasonic energy. The ashed section of the polyether amide film, near the thermal effect section, had a shape shown in FIG. 1 and a size of 50 μm×250 μm.

Figure 12:
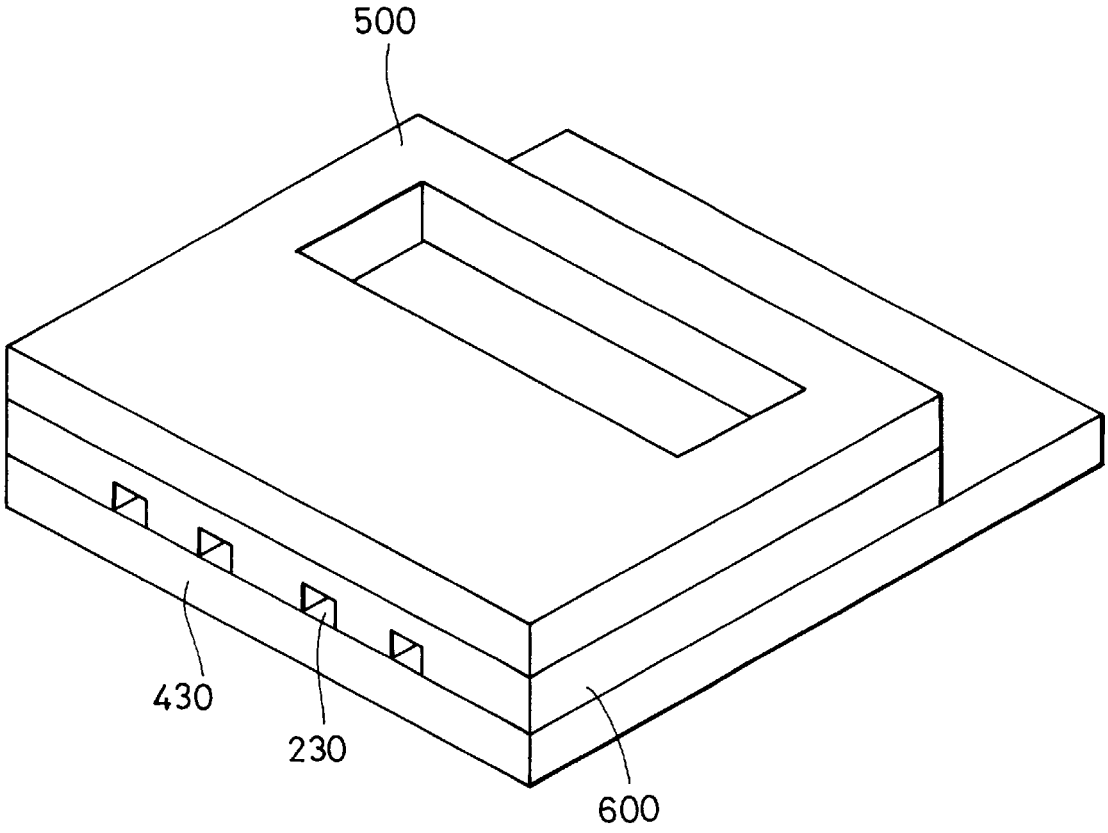
FIG. 12 is a schematic isometric view of an ink-jet head of Example 5.

With reference to FIG. 12, a grooved top board was bonded to the upper face of the substrate. The grooved top board consisted of a glass board 500 and a polyether amide film 600 with a thickness of 50 μm formed thereon. The polyether amide film 600 was formed by two cycles of spin coating of a polyether amide (HIMAL) solution with a viscosity of 900 cP, drying at 70° C. for 30 minutes, and then baking under the conditions A and B in Table 2.

A resist was applied onto the other surface not having the polyether amide film 600 of the glass substrate 500, and patterned. The glass board 500 was patterned using an aqueous mixture of hydrofluoric acid and ammonium fluoride to form an ink supply port. After removing the resist, the top board was cut using a dicer. Ink channels 230 having a width of 50 μm, a depth of 40 μm, and a length of 2 μm were formed on the polyether amide film 600 by cutting.

Since ink channels are formed by direct cutting of a glass plate in conventional technologies, cracking and chipping inevitably occur. The polyether amide layer 600 in accordance with the present invention, however, can be cut without cracking or chipping.

The substrate 430 was placed on a hot plate at 300° C., and the grooved top board 500 was placed and aligned on the substrate 430. The grooved top board 500 was pressed for 10 seconds using a heater at 300° C. to weld the grooved top board 500 with the substrate 430.

In this example, the polyether amide layer was also provided at the portion of the substrate 430 corresponding to bottom walls of nozzles to facilitate bonding of the top board 500 provided with the nozzles to the substrate 430. The polyether polyamide layer absorbs a large difference in level caused by wiring on the substrate 430, and thus can facilitate bonding of the grooved top board 400 to the substrate 430, although such bonding can be achieved by welding of the polyether amide layer coated on the top board 500 even when the substrate 430 does not have the polyether amide layer.

Pulses of 30-volts, 10-sec, and 3-kHz were applied to the electrothermal transducers of the resulting ink-jet head. Droplets of the ink stored in the orifices were stably discharged in response to the applied signals. The quality of the print was satisfactory. The polyether amide layer did not cause problems, such as separation.

EXAMPLE 6

Figure 13:
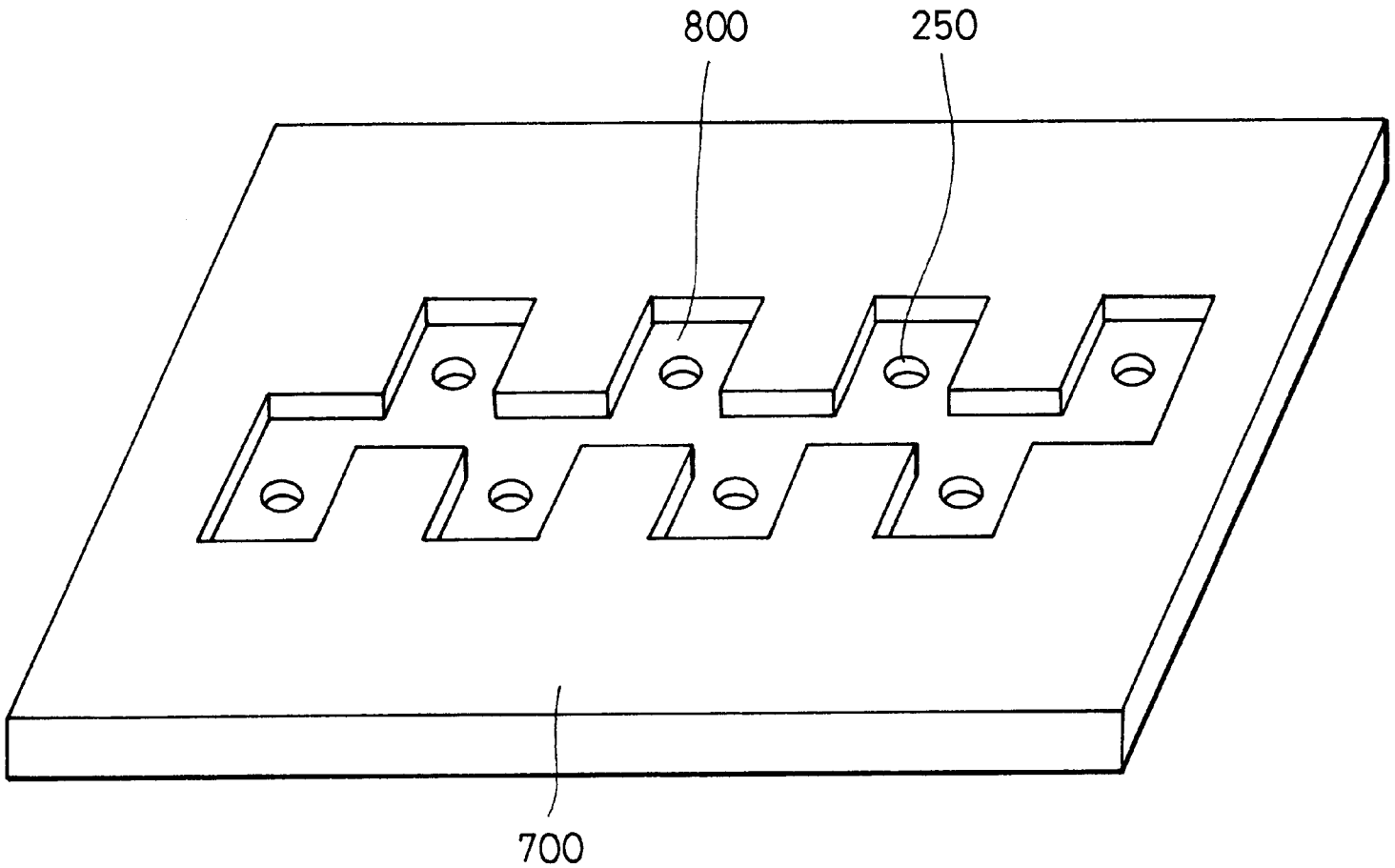
FIG. 13 is a schematic isometric view of an orifice plate of Example 6.
Figure 14:
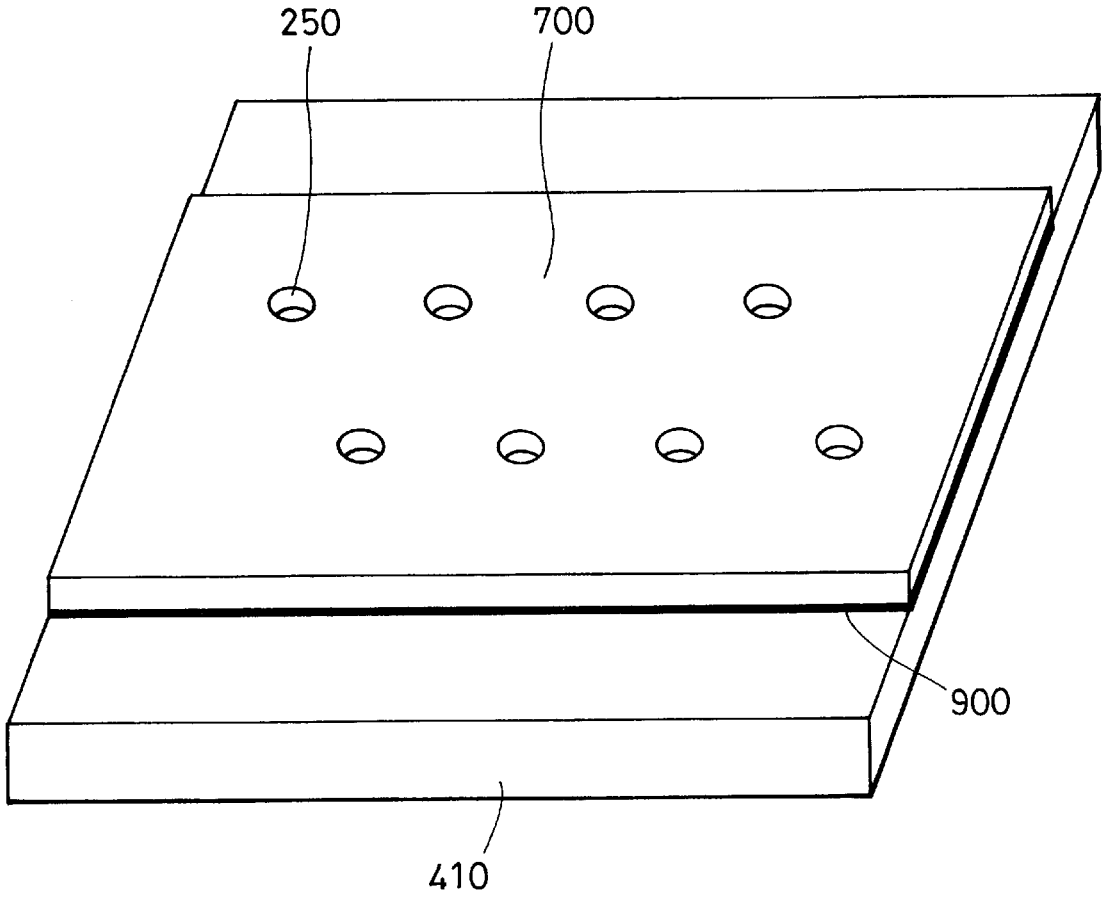
FIG. 14 is a schematic isometric view of an ink-jet head of Example 6.

With reference to FIGS. 13 and 14, a substrate 410 was produced as in Example 5. A polyether amide (HIMAL) solution having a viscosity of 900 cP was applied twice on the substrate 410 by a spin coating process, dried at 70° C. for 30 minutes, and then baked at 120° C. for 3 hours. The resulting polyether amide film had a thickness of 30 $\mu$m. A resist pattern was formed in the polyether amide film. An ink channel was formed by an oxygen plasma process, and then the resist pattern was removed.

An etching resist PMERP-RF30S (trade name, by Tokyo Ohka Kogyo Co., Ltd.) was applied onto a copper plate, an ink channel 800 was patterned, and then the resist was removed. Discharge nozzles 250 were formed using a YAG (yttrium-aluminum-garnet) laser, and the surface of the copper plate was plated with gold. An orifice plate 700 was thereby formed.

The substrate 410 and the orifice plate 700 were aligned and bonded to each other. These were placed onto a hot plate at 300° C., and then the orifice plate 700 was pressed for 10 seconds using a heater at 300° C. to weld it with the substrate 410. An ink-jet head was thereby formed as shown in FIG. 14.

Pulses of 30-volts, 10-sec, and 3-kHz were applied to the electrothermal transducers of the resulting ink-jet head. Droplets of the ink stored in the orifices were stably discharged in response to the applied signals, as in Example 5. The quality of the print was satisfactory. The polyether amide layer did not cause problems, such as separation.

EXAMPLE 7

Figure 15:
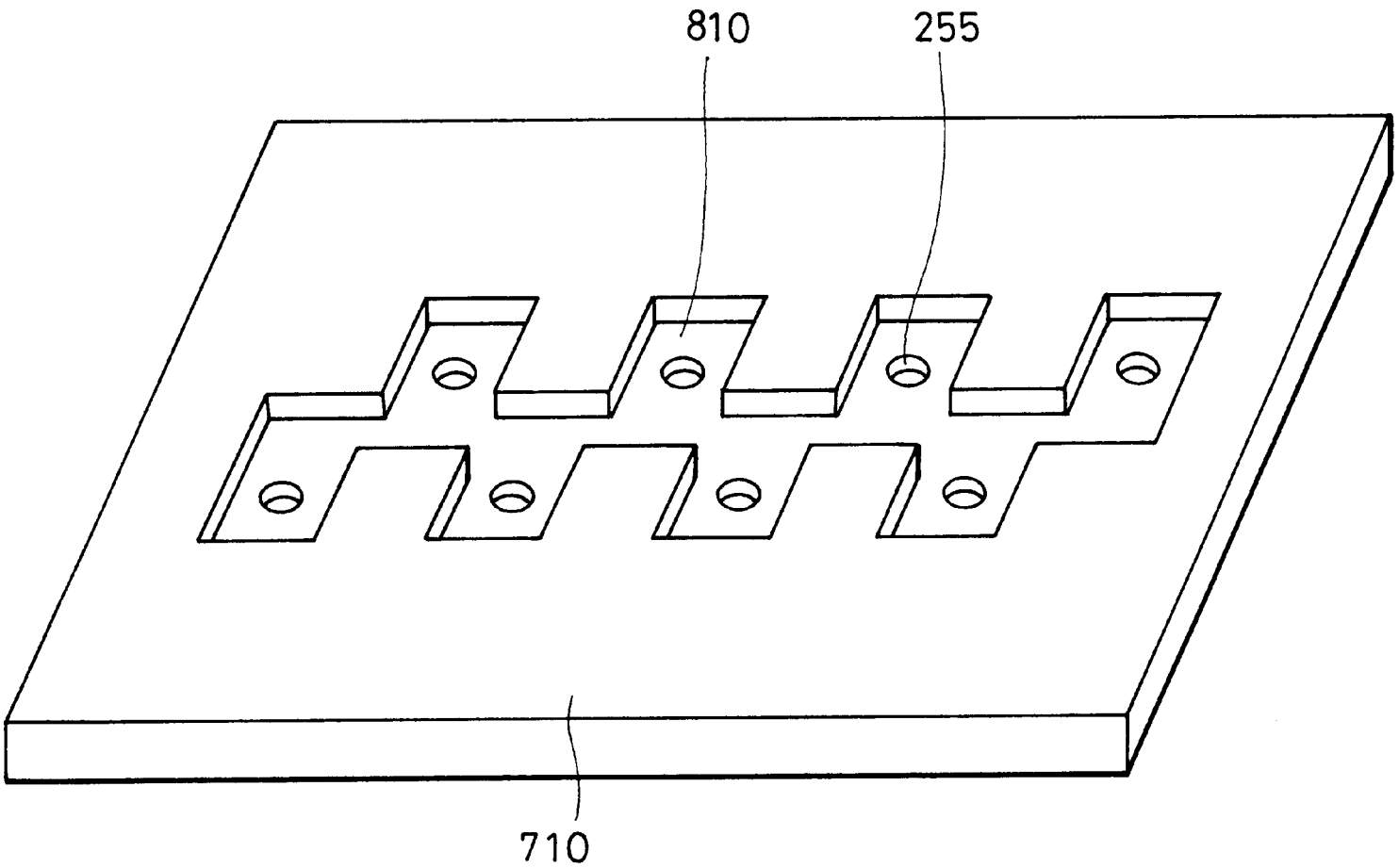
FIG. 15 is a schematic isometric view of an orifice plate of Example 7.

A substrate was formed as in Example 5. A polyether amide (HIMAL) solution having a viscosity of 900 cP was applied twice on the substrate by a spin coating process, and dried at 70° C. for 30 minutes. The substrate was bonded to a resin orifice plate 710 shown in FIG. 15 to form ink channels and discharge nozzles. An ink channel 810 was simultaneously formed with the orifice plate 710 by molding, and then discharge nozzles 255 were formed using an excimer laser.

The substrate and the orifice plate 710 were aligned and bonded to each other. These were placed into a vacuum chamber and a load was added thereto at room temperature to evaporate a solvent, butyl cellosolve acetate, used for dissolution of the polyether amide.

Since heat was not applied for bonding of the orifice plate to the substrate, these can be tightly bonded to each other without the adverse affect of heat, such as deformation of the ink channel and discharge nozzles. Thus, the present invention is capable of using an inexpensive resin orifice plate.

Pulses of 30-volts, 10-sec, and 3-kHz were applied to the electrothermal transducers of the resulting ink-jet head. Droplets of the ink stored in the orifices were stably discharged in response to the applied signals, as in Example 5. The quality of the print was satisfactory. The polyether amide layer did not cause problems, such as separation.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet head substrate comprising:

a thermal effect section for applying thermal energy to liquid to form a bubble in the liquid;

a nozzle, the thermal effect section being connected with the nozzle for discharging the liquid;

an electrothermal transducer for generating the thermal energy; and a pair of electrodes, wherein a resin layer comprising a polyether amide having a residual solvent content of 4% or less is formed on the surface of the substrate.

2. An ink-jet head comprising:

a nozzle for discharging liquid;

a liquid channel connected with the nozzle;

a substrate having a pressure-generating element for discharging the liquid, the liquid channel including the pressure-generating element; and a liquid channel component bonded to the substrate to form the liquid channel, wherein the substrate has a resin layer comprising a polyether amide resin having a residual solvent content of 4% or less at the bonded section to the liquid channel component.

3. An ink-jet head according to claim 2, wherein the polyether amide resin is thermoplastic.

4. An ink-jet head according to claim 2, wherein the liquid channel component comprises a resin.

5. An ink-jet head according to claim 4, wherein the liquid channel component is formed of a cationic polymerization compound of an epoxy resin.

6. An ink-jet head according to claim 2, wherein the liquid channel component is a top board having a groove for forming a part of the liquid channel.

7. An ink-jet head according to claim 6, wherein the top board is pressed and fixed to the substrate by an elastic member.

8. An ink-jet head according to claim 7, wherein the top board is formed by integral molding of a resin.

9. An ink-jet head according to claim 8, wherein the top board comprises a polysulfone or polyether sulfone.

10. An ink-jet head according to claim 2, wherein the nozzle is provided at a side away from the pressure-generating element.

11. An ink-jet head according to claim 2, wherein the pressure-generating element is an electrothermal transducer.

12. An ink-jet head according to claim 2, wherein the resin layer functions as a protective layer for the pressure-generating element.

13. An ink-jet head according to claim 2, wherein the liquid channel component and the substrate are bonded to each other by heat welding of the resin layer.

14. An ink-jet head according to claim 2, wherein the liquid channel component and the substrate are bonded to each other by vacuum drying of the resin layer.

15. A method for making an ink-jet head comprising a nozzle for discharging liquid, a liquid channel connected with the nozzle, a substrate having a pressure-generating element for discharging the liquid, the liquid channel including the pressure-generating element, and a liquid channel component bonded to the substrate to form the liquid channel, the met-hod comprising the steps of:

forming a polyether amide layer having a residual solvent content of 4% or less on the pressure-generating element of the substrate;

forming a liquid channel pattern on the polyether amide layer using a soluble resin;

forming a covering resin layer for forming a liquid channel wall on the liquid channel pattern;

forming the nozzle in the covering resin layer above the pressure-generating element; and dissolving the liquid channel pattern.

16. A method for making an ink-jet head according to claim 15, further comprising the step of patterning the polyether amide layer by an oxygen plasma ashing process.

17. A method for making an ink-jet head according to claim 15, wherein the polyether amide resin is thermoplastic.

18. A method for making an ink-jet head according to claim 15, wherein the covering resin layer is formed of a cationic polymerization compound of an epoxy resin.

19. A method for making an ink-jet head according to claim 15, wherein the pressure-generating element is an electrothermal transducer.

* * * * *

UNITED STATES PATENT AND TRADEMARK OFFICE

CERTIFICATE OF CORRECTION

PATENT NO. : 6,390,606 B1
DATED : May 21, 2002
INVENTOR(S) : Makoto Terui et al.

It is certified that error appears in the above-identified patent and that said Letters Patent is hereby corrected as shown below:

Column 1,
Line 34, "Tthe" should read -- The --.

Column 3,
Line 56, "layers 105" should read -- layer 105 --.

Column 10,
Line 29, "line-and space" should read -- line-and-space --; and
Line 67, "Kabusiki" should read -- Kabushiki --.

Column 11,
Line 5, "line-and space" should read -- line-and-space --.

Column 13,
Line 10, "board 400" should read -- board 500 --;
Line 15, "10-sec," should read -- 10-μsec, --; and
Line 45, "10-sec," should read -- 10-μsec, --.

Column 14,
Line 3, "affect" should read -- effect --; and
Line 6, "10-sec," should read -- 10-μsec, --.

Column 15,
Line 18, "met-hod" should read -- method --.

Signed and Sealed this

Third Day of December, 2002

JAMES E. ROGAN
*Director of the United States Patent and Trademark Office*